US005229582A

United States Patent [19]

Graham

[11] Patent Number: 5,229,582

[45] Date of Patent: Jul. 20, 1993

[54] FLEXIBLE HEATING ELEMENT HAVING EMBOSSED ELECTRODE

[75] Inventor: Thomas G. Graham, Glenrothes, Scotland

[73] Assignee: Thermaflex Limited, United Kingdom

[21] Appl. No.: 730,795

[22] PCT Filed: Jan. 19, 1990

[86] PCT No.: PCT/GB90/00088

§ 371 Date: Jul. 24, 1991

§ 102(e) Date: Jul. 24, 1991

[87] PCT Pub. No.: WO90/09086

PCT Pub. Date: Aug. 9, 1990

[30] Foreign Application Priority Data

Jan. 25, 1989 [GB] United Kingdom ..... 8901570

[51] Int. Cl.[5] ..... H05B 3/08; H05B 3/34; H01C 3/06

[52] U.S. Cl. ..... 219/541; 219/528; 219/549; 338/211

[58] Field of Search ..... 219/528, 541, 546, 548, 219/549; 338/210, 211, 212, 328; 174/259; 156/47, 209, 219

[56] References Cited

U.S. PATENT DOCUMENTS

| | | | |
|---|---|---|---|
| 3,996,447 | 12/1976 | Bouffard et al. | 219/540 |
| 4,250,348 | 2/1981 | Ellis et al. | 219/528 |
| 4,482,801 | 11/1984 | Habata et al. | 219/540 |
| 4,534,886 | 8/1985 | Kraus et al. | 252/502 |
| 4,619,871 | 10/1986 | Takami | 428/607 |
| 4,656,339 | 4/1987 | Grise | 219/528 |
| 4,818,823 | 4/1989 | Bradley | 174/68.5 |

FOREIGN PATENT DOCUMENTS

| | | | |
|---|---|---|---|
| 0042448 | 12/1980 | European Pat. Off. . | |
| 0217703 | 4/1987 | European Pat. Off. . | |
| 2401203 | 7/1975 | Fed. Rep. of Germany . | |
| 0098696 | 5/1987 | Japan | 174/259 |
| 1087794 | 10/1967 | United Kingdom . | |
| 1191847 | 5/1970 | United Kingdom . | |
| 1333086 | 10/1973 | United Kingdom . | |
| 1478919 | 7/1977 | United Kingdom . | |
| 1569161 | 6/1980 | United Kingdom . | |

*Primary Examiner*—Bruce A. Reynolds
*Assistant Examiner*—Michael D. Switzer
*Attorney, Agent, or Firm*—Ostrolenk, Faber, Gerb & Soffen

[57] ABSTRACT

A flexible heating element is constructed by securing a flexible layer of conductive material constituting an electric heater to a flexible sheet. The layer of conductive material is connected to an electrical supply means by at least one electrode which has an embossed surface with protuberances that make direct contact with the layer of conductive material. A thermoplastic polymeric based adhesive at the interface between the embossed surface and the conductive layer secures the latter to the electrode.

10 Claims, 2 Drawing Sheets

FLEXIBLE HEATING ELEMENT HAVING EMBOSSED ELECTRODE

The present invention relates to a flexible heating element comprising a flexible sheet substrate, a layer of an electrically conductive material for generating heat on conduction of an electric current and supply means for applying an electric current to the conductive material.

Such heating elements can be used in applications such as ceiling heating, underfloor heating, wooden/-metal panel heating, motor vehicle mirror and car seat heating, and a wide range of horticultural and agricultural applications.

A problem which arises in connection with heating elements of this kind is that of ensuring good electrical contact between the supply means and the layer of electrically conductive material, that is, low resistance between the supply and conductive layer.

United Kingdom Patent 1,087,794 proposes the use of an electrode strip with pre-cut tabs which pierce both the conductive layer and the substrate. United Kingdom Patent 1,333,086 also describes a similar arrangement in which the foil electrode strips are secured to the substrate by means of a plurality of eyelets. Both of these products, however, are subject to the disadvantage that piercing of the substrate weakens it considerably and the heating element is liable to tearing.

United Kingdom Patent 1,191,847 discloses the use of a conductive adhesive to secure the supply electrodes to the conductive layer but this does not always provide the good contact necessary.

Accordingly, the flexible heating element of the invention is characterised in that the supply means includes at least one electrode having an embossed surface, the embossed surface of the electrode being bonded to the conductive material by means of thermoplastic polymeric based adhesive. Preferably, protruberances on the embossed surface make physical contact with the conductive material.

With an arrangement in accordance with the invention, a reliable low resistance connection can be effected between a power supply and the conductive material.

An embodiment of the invention will now be described by way of example with reference to accompanying drawings, in which.

Figure 1:
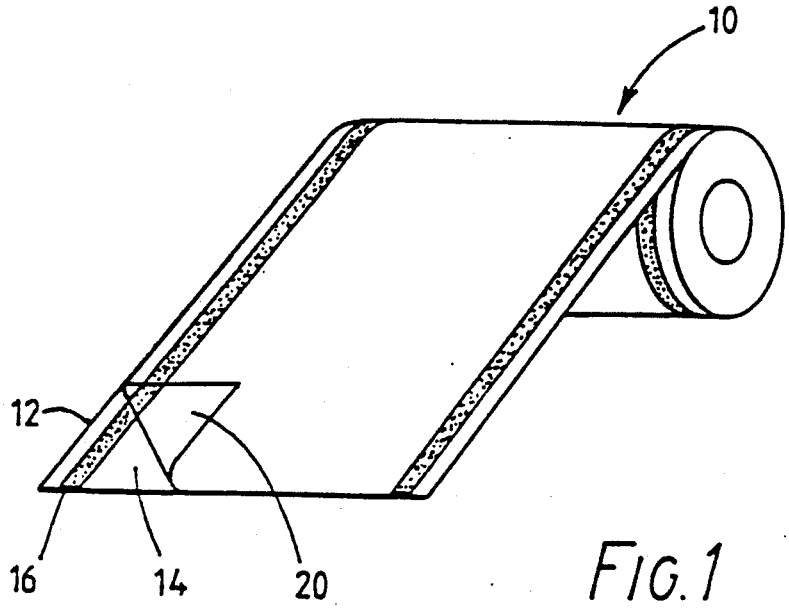
FIG. 1 is a perspective view showing a length of a flexible heating element stored in a roll, and partially unrolled.
Figure 2:
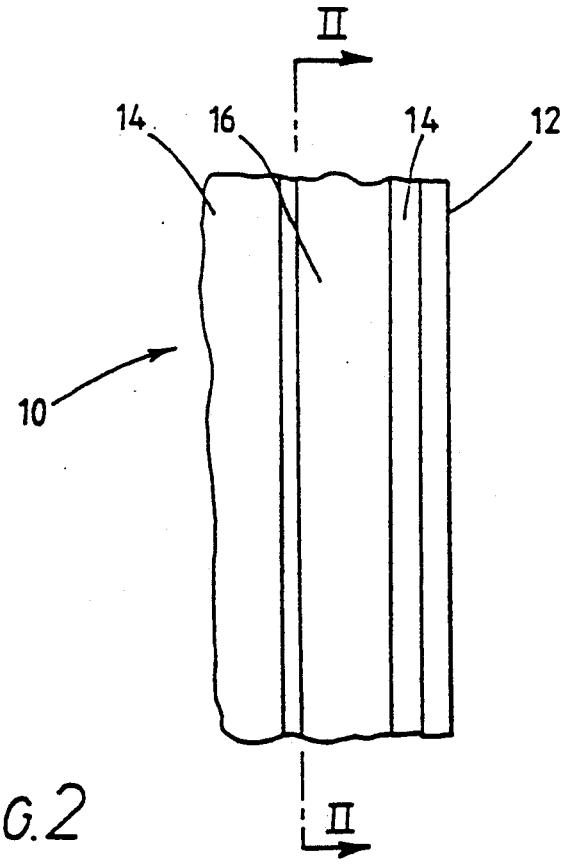
FIG. 2 is a plan view of the edge region of the flexible heating element shown in FIG. 1.
Figure 3:
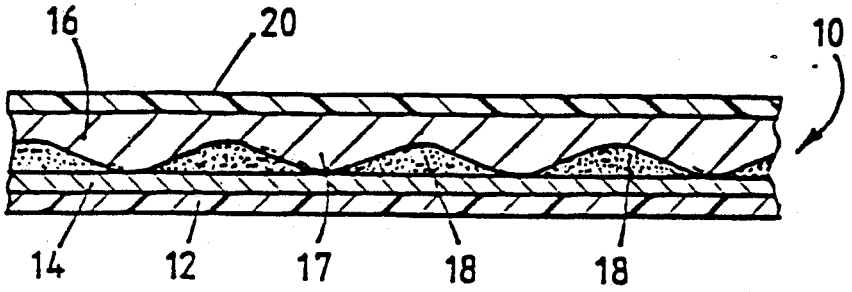
FIG. 3 is a sectional view along the line II—II of FIG. 2.

Referring to FIGS. 1, 2, and 3, a flexible heating element 10 includes a rectangular flexible sheet substrate 12 of an electrically insulating material. The material used for the substrate will depend on the requirements for the intended application of the heating element, for example on overall thickness, operating temperature and the nature of the application environment. In the present embodiment, the operating temperature is intended to be less than 100° C., and the substrate material used is polyethylene terephthalate. The substrate thickness is approximately 75 μm. The heating element is sufficiently flexible that it can be stored in a roll, as in FIG. 1.

The substrate 12 carries a layer of an electrically conductive material 14. When an electric current is passed through the conductive material 14, heat is produced owing to the predetermined resistance of the conductive material. The conductive material 14 is a thermoplastic polymer based material, utilising a blend of conductive and non-conductive constituents. The ratio of the conductive and non-conductive constituents used determines the resistivity of the conductive material 14, and hence partly determines the output power of the heating element. The conductive constituent contains a mixture of carbon black and graphite to provide the conductive property.

Depending on the application for which the heating element is intended, the layer of conductive material 14 may be formed as a continuous layer substantially covering the surface of the substrate 12, or it may be formed as a predetermined pattern covering only parts of the substrate.

A copper strip electrode 16 is bonded to the edge portion of the conductive material 14 by means of a conductive thermoplastic polymeric based adhesive 18. The electrode is of copper for its high conductive properties. The surface of the electrode 16 nearest the conductive material 14 is embossed with protruberances 17. The protruberances 17 penetrate the adhesive layer 18, thereby improving the electrical contact between the electrode 16 and the conductive material 14. The protruberances 17 make physical contact with the conductive material 14.

A second electrode (not shown) similar to the above electrode is also bonded to another region of the conductive material 14, adjacent an opposing edge of the sheet substrate, by means of the same adhesive system. The electrodes are attached to a power supply (not shown) to apply an electric current through the conductive material 14, thereby producing heat.

For a given operating voltage V, the power disipated W per unit area of the conductive material 14 is dependent on the resistance R per unit surface area of the conductive material layer 14, and the distance D of separation of the electrodes 16. The folowing equation is used:

$$R=(V^2\times L)/(W\times D)$$

where L is the length of the heating element.

A layer of insulating material 20, for example of the same material as the substrate 12, is bonded over the electrodes 16 and the conductive material 14.

In a preferred method for producing the heating element described above, as a first step the conductive material layer 14 is applied in the desired pattern, or as a continuous layer, by a rotary screen printing technique, which is known in itself. The coated substrate is then cured by passing it through a forced air drying tunnel.

An overall application of a modified thermoplastic based adhesive is then metered on to the coated substrate. In association with a further pass through the drying tunnel, copper electrodes are laid firmly in position, allowing the protruberances 17 to penetrate the adhesive.

The final layer of insulating material is bonded to the surface of the electrodes 16 and the conductive material 14 by a lamination process.

Figure 4:
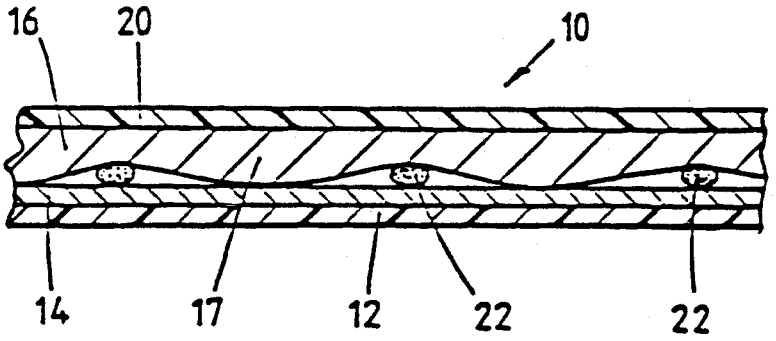
FIG. 4 is a sectional view similar to FIG. 3, but showing an alternative arrangement in the heating element.

Referring to FIG. 4, in an alternative method for producing the heating element, the adhesive is not applied as an overall coating, but is applied as a discontinuous spot pattern 22. The distance between adjacent spots 22 is roughly equal to the spacing of the protruberances 17 on the embossed surface of the electrode 16. When the electrode 16 is laid in position on the conductive material 14, the spots 22 of conductive adhesive can spread to enable firm contact between the protruberances 17 and the conductive material 14 to be achieved. The contact is maintained under pressure by the spots 22 of adhesive as a result of final stage processing.

It will be appreciated that although in the embodiment described above, the substrate is made of polyethylene terephthalate, other types of material are also suitable, for example aromatic polyamides and polyether sulphones.

It will also be appreciated that although in the embodiment described above, the adhesive is a conductive adhesive, a non-conductive thermoplastic polymeric based adhesive can also be used. Electrical contact between the electrode 16 and the conductive material 14 would still be established owing to the effective penetration through the adhesive by the protruberances 17.

The embodiment described above is intended for use at operating temperatures of less than 100° C. For greater operating temperatures, thermoset thermally cured polymer based conductive materials are used as the conductive material.

I claim:

1. A flexible heating element (10), comprising a flexible sheet substrate (12), a flexible layer of an electrically conductive material (14) for generating heat on conduction of an electric current, and supply means for applying an electric current to the layer of electrically conductive material; the supply means includes at least one electrode (16) having an embossed surface, the embossed surface of the electrode (16) being bonded to the conductive material (14) by means of a thermoplastic polymeric based adhesive (18), and protuberances (17) on the embossed surface make physical contact with the layer of electrically conductive material (14).

2. A flexible heating element according to claim 1, wherein the adhesive (18) is a conductive adhesive.

3. A flexible heating element according to claim 1, wherein the electrode (16) is a strip of metal.

4. A flexible heating element according to claim 1, wherein the heating element (10) is substantially rectangular and includes two electrodes (16) each having an embossed surface, the electrodes (16) being positioned adjacent opposing edges of the heating element (10).

5. A flexible heating element according to claim 1, wherein the conductive material (14) is disposed on the substrate (12) as continuous layer.

6. A flexible heating element according to claim 1, wherein the conductive material (14) comprises a blend of conductive and nonconductive constituents.

7. A flexible heating element according to claim 6, wherein the constituents are thermoplastic, or thermoset, polymer compositions.

8. A flexible heating element according to claim 6, wherein the conductive constituent includes a mixture of carbon black and graphite.

9. A method of producing the heating element of claim 1, comprising applying to a flexible sheet substrate (12) a layer of a conductive material (14) in a desired continuous or non continuous disposition, applying to the layer a thermoplastic polymeric based adhesive (18), and pressing an electrode (16) having an embossed surface onto the conductive adhesive (18) such that the embossed surface is in electrical contact with the conductive material (14).

10. A method according to claim 9, wherein the adhesive (18) is applied to cover substantially the region of the conductive material (14) against which the electrode (16) is pressed.

* * * * *